US009583001B2

(12) United States Patent
Ahiko

(10) Patent No.: US 9,583,001 B2
(45) Date of Patent: Feb. 28, 2017

(54) TIMETABLE GENERATION DEVICE, TIMETABLE GENERATION METHOD, PROGRAM, TIMETABLE GENERATION SYSTEM, AND USER TERMINAL

(71) Applicant: Hitachi Systems, Ltd., Shinagawa-ku, Tokyo (JP)

(72) Inventor: Shigeto Ahiko, Yokohama (JP)

(73) Assignee: Hitachi Systems, Ltd., Tokyo (JP)

( * ) Notice: Subject to any disclaimer, the term of this patent is extended or adjusted under 35 U.S.C. 154(b) by 0 days.

(21) Appl. No.: 14/772,703

(22) PCT Filed: Mar. 12, 2013

(86) PCT No.: PCT/JP2013/056777

§ 371 (c)(1),
(2) Date: Sep. 3, 2015

(87) PCT Pub. No.: WO2014/136277

PCT Pub. Date: Sep. 12, 2014

(65) Prior Publication Data

US 2016/0012724 A1 Jan. 14, 2016

(30) Foreign Application Priority Data

Mar. 4, 2013 (JP) ..... 2013-041485

(51) Int. Cl.
*G08G 1/123* (2006.01)
*G08G 1/13* (2006.01)
(Continued)

(52) U.S. Cl.
CPC ..... *G08G 1/13* (2013.01); *B61L 27/0016* (2013.01); *G08G 1/127* (2013.01); *B61L 25/025* (2013.01)

(58) Field of Classification Search
CPC ..... G08G 1/127; G08G 1/13; B61L 27/0016; B61L 25/025
(Continued)

(56) References Cited

U.S. PATENT DOCUMENTS 6,013,007 A * 1/2000 Root ..... A63B 24/0006 482/8
2001/0026276 A1* 10/2001 Sakamoto ..... G01C 21/3638 345/473
(Continued)

FOREIGN PATENT DOCUMENTS

JP 2002-178923 A 6/2002
JP 2004-46404 2/2004
(Continued)

OTHER PUBLICATIONS

Corresponding Japanese Office Action dated Aug. 18, 2015 with English-language translation (8 pages).
(Continued)

*Primary Examiner* — Daryl Pope
(74) *Attorney, Agent, or Firm* — Crowell & Moring LLP

(57) ABSTRACT

Information about a time at which a vehicle of public transportation passes an arbitrary point is provided. A timetable generating device includes: an obtaining unit which obtains location information of a specified point which is an arbitrary point along a route and for which a timetable is to be generated; a time identifying unit which identifies a passage time at which a vehicle of public transportation passes the specified point; a timetable generating unit which generates a timetable that includes the identified passage time; and a timetable outputting unit which outputs the generated timetable.

10 Claims, 14 Drawing Sheets

(51) Int. Cl.
*G08G 1/127* (2006.01)
*B61L 27/00* (2006.01)
*B61L 25/02* (2006.01)

(58) Field of Classification Search
USPC ..... 340/994, 539.1, 539.11; 705/5, 7.14; 345/473
See application file for complete search history.

(56) References Cited

U.S. PATENT DOCUMENTS

| | | | | |
|---|---|---|---|---|
| 2006/0164259 | A1* | 7/2006 | Winkler | G08G 1/127 340/944 |
| 2009/0234564 | A1* | 9/2009 | Onishi | G06Q 10/02 705/5 |
| 2009/0313077 | A1* | 12/2009 | Wheeler, IV | G01C 21/26 705/7.14 |
| 2013/0344859 | A1* | 12/2013 | Abramson | G06Q 50/265 455/418 |

FOREIGN PATENT DOCUMENTS

| | | | |
|---|---|---|---|
| JP | 2004-106660 | A | 4/2004 |
| JP | 2005-289248 | A | 10/2005 |
| JP | 2006-47126 | A | 2/2006 |
| JP | 2011-105117 | A | 6/2011 |
| JP | 2012-20632 | A | 2/2012 |

OTHER PUBLICATIONS

Corresponding Japanese Decision to Grant a Patent dated Nov. 17, 2015 with English-language translation (6 pages).
International Search Report (PCT/ISA/210) dated Jun. 4, 2013, with English translation (Three (3) pages).
Japanese language Written Opinion (PCT/ISA/237) dated Jun. 4, 2013 (Four (4) pages).
English translation of Japanese Office dated Aug. 18, 2015 (Four (4) pages).

* cited by examiner

Fig 2

PASSAGE POINT INFORMATION 140

PASSAGE POINT RECORD

| 140a ROUTE ID | 140b ORIGINATING BUS STOP ID | 140c DESTINATION BUS STOP ID | 140d PASSAGE POINT COUNT | 140e LATITUDE | 140f LONGITUDE | 140g BUS STOP FLAG | 140h BUS STOP ID | 140i INTER-PASSAGE POINT DISTANCE |
|---|---|---|---|---|---|---|---|---|
| 1 | 11 | 130 | 30 | *** | *** | 1 | 11 | 0 |
| | | | | *** | *** | 0 | - | 200 |
| | | | | *** | *** | 1 | 13 | 200 |
| | | | | ... | ... | ... | ... | ... |
| 2 | 21 | 220 | 20 | *** | *** | 1 | 21 | 0 |
| | | | | *** | *** | 1 | 22 | 190 |
| | | | | *** | *** | 1 | 23 | 220 |
| | | | | ... | ... | ... | ... | ... |
| 3 | 31 | 340 | 40 | *** | *** | 1 | 31 | 0 |
| | | | | *** | *** | 0 | - | 250 |
| | | | | *** | *** | 0 | - | 400 |
| | | | | ... | ... | ... | ... | ... |
| ... | ... | ... | ... | ... | ... | ... | ... | ... |

BUS ROUTE RECORD

Fig 3

BUS INFORMATION 150

BUS STOP RECORD

| 150a BUS ID | 150b BUS NUMBER | 150c INBOUND/ OUTBOUND FLAG | 150d ROUTE ID | 150e SPEED | 150f ORIGINATING BUS STOP ID | 150g DESTINATION BUS STOP ID | 150h BUS STOP COUNT | 150i BUS STOP ID | 150j ARRIVAL TIME | 150k DEPARTURE TIME | 150l STOPPING FLAG |
|---|---|---|---|---|---|---|---|---|---|---|---|
| 1 | U1 | 1 | 1 | 60 | 11 | 130 | 20 | 11 | 5:55 | 6:00 | 1 |
| | | | | | | | | 13 | 6:04 | 6:05 | 1 |
| | | | | | | | | 14 | 6:11 | 6:12 | 1 |
| | | | | | | | | 15 | 6:20 | 6:21 | 1 |
| | | | | | | | | ... | ... | ... | ... |
| 2 | D1 | 0 | 1 | 60 | 130 | 11 | 20 | 130 | 6:10 | 6:15 | 1 |
| | | | | | | | | 129 | 6:20 | 6:21 | 1 |
| | | | | | | | | 128 | 6:29 | 6:30 | 1 |
| | | | | | | | | 127 | 6:40 | 6:41 | 1 |
| | | | | | | | | ... | ... | ... | ... |
| 3 | U2 | 1 | 1 | 60 | 11 | 130 | 20 | 11 | 6:25 | 6:30 | 1 |
| | | | | | | | | 13 | 6:34 | 6:35 | 1 |
| | | | | | | | | 14 | 6:41 | 6:42 | 1 |
| | | | | | | | | 15 | 6:50 | 6:51 | 1 |
| | | | | | | | | ... | ... | ... | ... |
| ... | ... | ... | ... | ... | ... | ... | ... | ... | ... | ... | ... |

BUS RECORD

Fig 4

PASSAGE TIME INFORMATION 160

| 160a OUTPUT POINT | 160b ROUTE ID | 160c EARLIEST PASSAGE TIME | 160d REGULAR PASSAGE TIME | 160e LATEST PASSAGE TIME |
|---|---|---|---|---|
| *** | 1 | 6:52 | 6:59 | 7:03 |
| | | 7:12 | 7:16 | 7:20 |
| | | 7:32 | 7:36 | 7:40 |
| | | ⋮ | ⋮ | ⋮ |
| ⋮ | ⋮ | ⋮ | ⋮ | ⋮ |

OUTPUT POINT RECORD

PASSAGE TIME RECORD

Fig 5

TIMETABLE INFORMATION 170

| 170a | 170b | 170c | 170d | 170e |
|---|---|---|---|---|
| OUTPUT POINT | PASASGE TIME (HOUR) | EARLIEST PASSAGE TIME (MINUTE) | REGULAR PASSAGE TIME (MINUTE) | LATEST PASSAGE TIME (MINUTE) |
| *** | 4 | – | – | – |
| | 5 | – | – | – |
| | 6 | 52 | 59 | 03 |
| | 7 | 12 | 16 | 20 |
| | | 32 | 36 | 40 |
| | ⋮ | ⋮ | ⋮ | ⋮ |
| ⋮ | ⋮ | ⋮ | ⋮ | ⋮ |

OUTPUT POINT RECORD

PASSAGE TIME RECORD

Fig 14

130

| HOUR | MINUTE [EARLIEST - REGULAR - LATEST] |
|---|---|
| 4 | |
| 5 | |
| 6 | [27-32-35] |
| 7 | [12-16-20][32-36-40] |
| 8 | [12-16-20][32-36-40][52-56-59] |
| 9 | [02-05-08][12-16-20][32-36-40][55-59-03] |
| 10 | [12-16-20][32-36-40] |
| 11 | [12-16-20][32-36-40] |
| 12 | [58-02-06][32-36-40][50-54-58] |
| 13 | [12-16-20][32-36-40] |
| 14 | [12-16-20][32-36-40] |
| 15 | [12-16-20][32-36-40] |
| 16 | [12-16-20][32-36-40][58-02-06] |
| 17 | [32-36-40][50-54-58][58-02-06] |
| 18 | [32-36-40][50-54-58] |
| 19 | [12-16-20][32-36-40] |
| 20 | [12-16-20][32-36-40] |

TIMETABLE GENERATION DEVICE, TIMETABLE GENERATION METHOD, PROGRAM, TIMETABLE GENERATION SYSTEM, AND USER TERMINAL

TECHNICAL FIELD

The present invention relates to generating a timetable. The present invention claims priority to Japanese Patent Application No. 2013-41485 filed on Mar. 4, 2013, the contents of which are incorporated herein by reference in its entirety for the designated states where incorporation by reference of literature is allowed.

BACKGROUND ART

Patent Literature 1 describes a transportation navigation system which searches for a route from a boarding station to an exit station, and gives guidance at a point in time that precedes, by a given length of time, the time of passage of each of the boarding station, an interchange station, and the exit station on the found route.

CITATION LIST

Patent Literature

[PTL 1] Japanese Patent Laid-open Publication No. 2002-178923

SUMMARY OF INVENTION

Technical Problem

There are cases where one wishes to know what time a vehicle of public transportation such as a train or a bus passes a point that is not a railroad station, a bus stop, or any other previously established points, for example, the time of passage of a point along a railroad between railway stations, or a point along a road between bus stops. For instance, if the operation situation or the like of public transportation at the site of railroad construction or road construction can be known in advance, the construction can be planned so that the construction work and the operation of public transportation are not affected.

Patent Literature 1 is about a technology of obtaining the time of passage of a boarding station, an interchange station, and an exit station each. However, the object of Patent Literature 1 is not to obtain a time at which a train passes an arbitrary point to begin with.

It is therefore an object of the present invention to provide information about a time at which a vehicle of public transportation passes an arbitrary point.

Solution to Problem

This application includes a plurality of means for attaining at least a part of the object, and examples thereof are given as follows.

According to a first aspect of the present invention for solving the above-mentioned problem, there is provided a timetable generating device including: an obtaining unit which obtains location information of a specified point which is an arbitrary point along a route and for which a timetable is to be generated; a time identifying unit which identifies a passage time at which a vehicle of public transportation passes the specified point; a timetable generating unit which generates a timetable that includes the identified passage time; and a timetable outputting unit which outputs the generated timetable.

The obtaining unit may obtain information of a specified route which runs through the specified point, and the time identifying unit may identify the passage time at which the vehicle of public transportation passes the specified point, based on the location information of the specified point, location information of passage points that the vehicle of public transportation running on the specified route passes and that precede and follow the specified point, and information about passage times at which the vehicle of public transportation passes the points that precede and follow the specified point.

The time identifying unit may identify the passage time at which the vehicle of public transportation passes the specified point for at least one of inbound run and outbound run.

The time identifying unit may identify, as the passage time, at least one of a latest passage time, a regular passage time, and an earliest passage time at which the vehicle of public transportation passes the specified point.

The time identifying unit may identify passage times at which the vehicle of public transportation passes the specified point for the inbound run and for the outbound run, and the timetable outputting unit may output one timetable which displays the passage time on the inbound run and the passage time on the outbound run differently, or separate timetables one of which displays the passage time on the inbound run and another of which displays the passage time on the outbound run.

The time identifying unit may identify, as the passage time, the latest passage time, the regular passage time, and the earliest passage time at which the vehicle of public transportation passes the specified point, and the timetable outputting unit may output the timetable that displays the latest passage time and the earliest passage time in association with the regular passage time.

The obtaining unit may output a first screen which contains a diagram of the vehicle of the public transportation running on the specified route to receive specification of the specified point on the first screen, or may output a second screen which contains route information and map information to receive specification of the specified route and specification of the specified point on the second screen.

According to a second aspect of the present invention for solving the above-mentioned problem, there is provided a timetable generating method for use in a timetable generating device, including: an obtaining step of location information of a specified point which is an arbitrary point along a route and for which a timetable is to be generated; a time identifying step of identifying a passage time at which a vehicle of public transportation passes the specified point; a timetable generating step of generating a timetable that includes the identified passage time; and a timetable outputting step of outputting the generated timetable.

According to a third aspect of the present invention for solving the above-mentioned problem, there is provided a program for causing a computer to function as a timetable generating device, the program further causing the computer to function as: an obtaining unit which obtains location information of a specified point which is an arbitrary point along a route and for which a timetable is to be generated; a time identifying unit which identifies a passage time at which a vehicle of public transportation passes the specified point; a timetable generating unit which generates a timetable that includes the identified passage time; and a timetable outputting unit which outputs the generated timetable.

According to a fourth aspect of the present invention for solving the above-mentioned problem, there is provided a timetable generating system including: a user terminal; and a timetable generating device, in which the user terminal includes: an input unit which receives an input of location information of a specified point which is an arbitrary point along a route and for which a timetable is to be generated; a transmission unit which transmits the input location information of the specified point to the timetable generating device; a reception unit which receives from the timetable generating device a timetable that includes a passage time at which a vehicle of public transportation passes the specified point; and an output unit which outputs the received timetable, and the timetable generating device includes: an obtaining unit which obtains the location information of the specified point from the user terminal; a time identifying unit which identifies the passage time at which the vehicle of public transportation passes the specified point; a timetable generating unit which generates the timetable that includes the identified passage time; and a timetable outputting unit which transmits the generated timetable to the user terminal.

According to a fifth aspect of the present invention for solving the above-mentioned problem, there is provided a timetable generating method for use in a timetable generating system which includes a user terminal and a timetable generating device, the method including: an input step of receiving, by the user terminal, an input of location information of a specified point which is an arbitrary point along a route and for which a timetable is to be generated; a transmission step of transmitting, by the user terminal, the input location information of the specified point to the timetable generating device; an obtaining step of obtaining, by the timetable generating device, the location information of the specified point from the user terminal; a time identifying step of identifying, by the timetable generating device, a passage time at which a vehicle of public transportation passes the specified point; a timetable generating step of generating, by the timetable generating device, a timetable that includes the identified passage time; a timetable outputting step of transmitting, by the timetable generating device, the generated timetable to the user terminal; a reception step of receiving, by the user terminal, from the timetable generating device, the timetable that includes the passage time at which the vehicle of public transportation passes the specified point; and an output step of outputting, by the user terminal, the received timetable.

According to a sixth aspect of the present invention for solving the above-mentioned problem, there is provided a user terminal configured to hold communication to/from a timetable generating device, including: an input unit which receives an input of location information of a specified point which is an arbitrary point along a route and for which a timetable is to be generated; a transmission unit which transmits the input location information of the specified point to the timetable generating device; a reception unit which receives from the timetable generating device a timetable that includes a passage time at which a vehicle of public transportation passes the specified point; and an output unit which outputs the received timetable.

Advantageous Effects of Invention

According to the present invention, the information about a time at which the vehicle of public transportation passes an arbitrary point can be provided.

Other objects, configurations, and effects than those described above are made clear by a description of an embodiment given below.

BRIEF DESCRIPTION OF DRAWINGS

FIG. 2 is a diagram illustrating an example of the configuration of passage point information 140.

FIG. 3 is a diagram illustrating an example of the configuration of bus information 150.

FIG. 4 is a diagram illustrating an example of the configuration of passage time information 160.

FIG. 5 is a diagram illustrating an example of the configuration of timetable information 170.

FIG. 14 is a diagram illustrating an example of a UI screen 130 for outputting a timetable.

DESCRIPTION OF EMBODIMENT

An embodiment of the present invention is described with reference to the drawings.

Figure 1:
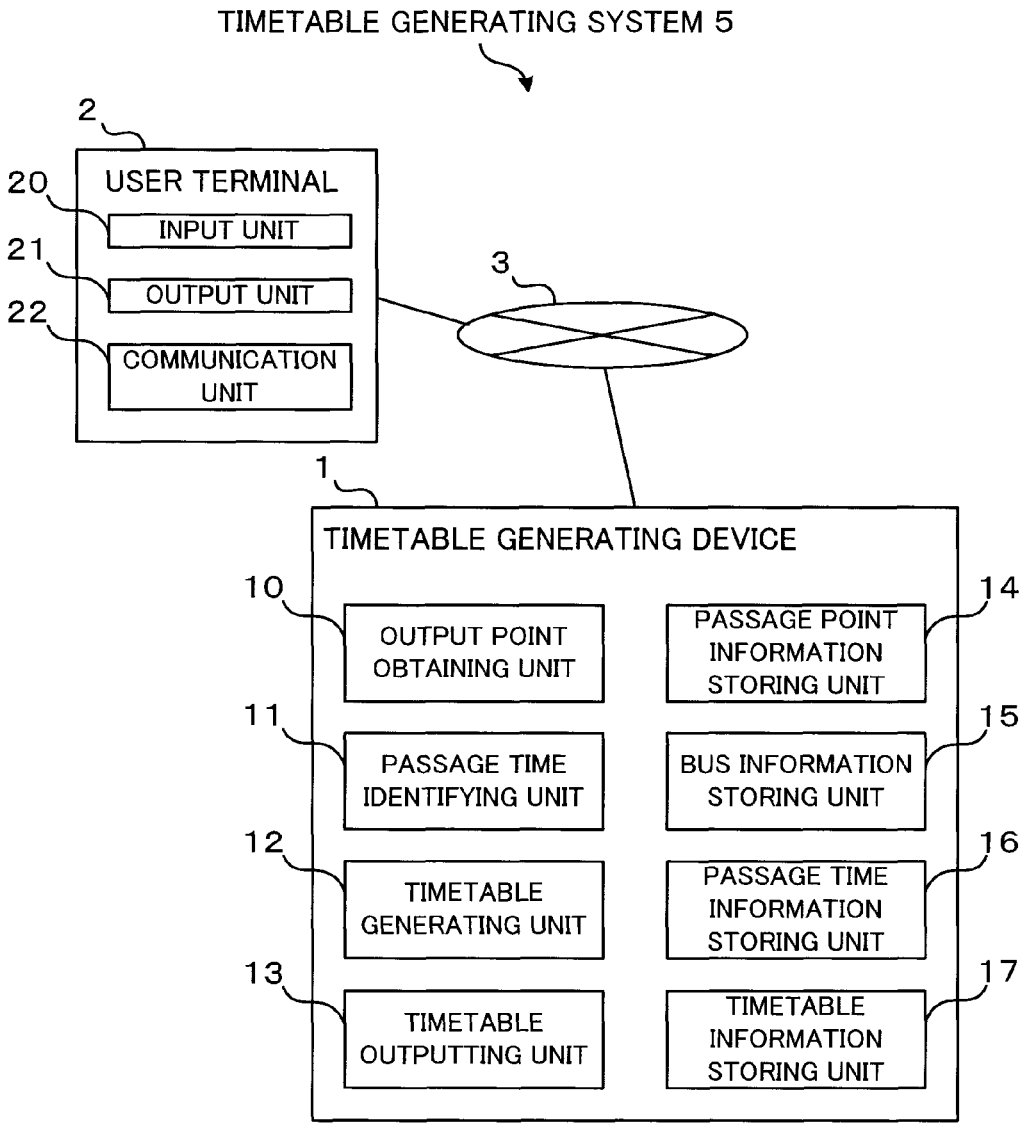
FIG. 1 is a diagram illustrating an example of the schematic configuration of a timetable generating system 5 according to an embodiment of the present invention.

FIG. 1 is a diagram illustrating an example of the schematic configuration of a timetable generating system 5 according to the embodiment of the present invention. The description of this embodiment takes as an example a case where public transportation is a fixed-route bus.

The timetable generating system 5 includes a timetable generating device 1 and a user terminal 2. The timetable generating device 1 and the user terminal 2 can transmit/receive information to/from each other over a network 3.

The timetable generating device 1 sends a user interface screen (hereinafter also referred to as "UI screen") to the user terminal 2 to control the user terminal 2 to display the UI screen. The timetable generating device 1 receives from the user terminal 2 input information which is input to the UI screen, and executes processing suitable for the input information. The timetable generating device 1 receives the specification of a point at which a timetable is to be generated (hereinafter also referred to as "output point") from the user terminal 2, generates a timetable indicating a time at which a bus passes the received output point, and sends the timetable to the user terminal 2. Details thereof are described later.

The user terminal 2 displays, among others, the UI screen received from the timetable generating device 1 on a display. The user terminal 2 receives an input made to the UI screen by a user via an input device such as a mouse, and transmits the input information to the timetable generating device 1.

The description given above on the configuration of the timetable generating system 5 with reference to FIG. 1 is about main components for describing features of the invention of this application, and the timetable generating system 5 is not limited to the configuration described above. The timetable generating system 5 also does not exclude the configurations of timetable generating systems that are common.

The timetable generating device 1 and the user terminal 2 are described in detail.

The timetable generating device 1 includes an output point obtaining unit 10, a passage time identifying unit 11, a timetable generating unit 12, a timetable outputting unit 13, a passage point information storing unit 14, a bus information storing unit 15, a passage time information storing unit 16, and a timetable information storing unit 17.

The output point obtaining unit 10 transmits a UI screen for receiving the specification of an output point at which a timetable is to be generated to the user terminal 2 via a communication I/F 54 (see FIG. 6) and the network 3. The output point obtaining unit 10 obtains, from the user terminal 2, via the communication I/F 54 and the network 3, information of an output point specified on the UI screen that has been transmitted to the user terminal 2. Alternatively, the output point obtaining unit 10 may display a UI screen for receiving the specification of an output point at which a timetable is to be generated on its own output device 56 (see FIG. 6), and obtain information of an output point specified on this UI screen via an input device 55 (see FIG. 6).

The passage time identifying unit 11 identifies a time at which a bus passes the output point obtained by the output point obtaining unit 10, based on passage point information 140 (see FIG. 2) which is stored in the passage point information storing unit 14, and bus information 150 (see FIG. 3) which is stored in the bus information storing unit 15. The passage time identifying unit 11 stores the identified time of passage in the passage time information storing unit 16 as passage time information 160 (see FIG. 4).

The timetable generating unit 12 generates timetable information at the obtained output point based on the passage time information 160, and stores the timetable information in the timetable information storing unit 17 as time table information 170 (see FIG. 5).

The timetable outputting unit 13 generates a UI screen that contains a timetable in a given output format, based on the timetable information 170, and transmits the UI screen to the user terminal 2 via the communication I/F 54 and the network 3.

The passage point information storing unit 14 stores the passage point information 140 for identifying a passage point along a bus route or the like. Information of each bus route is set in advance in the passage point information 140 in this embodiment. FIG. 2 is a diagram illustrating an example of the configuration of the passage point information 140.

The passage point information 140 includes, for each bus route, a bus route record where a route ID 140*a*, which is identification information of the bus route, an originating bus stop ID 140*b*, which is identification information of the originating bus stop of the bus route, a destination bus stop ID 140*c*, which is identification information of the destination bus stop of the bus route, a passage point count 140*d*, which indicates how many passage points (including stop points that are bus stops) are there along the bus route, and detailed passage point information are associated with one another. The detailed passage point information includes, for each passage point, a passage point record where a latitude 140*e* of the passage point, a longitude 140*f* of the passage point, a bus stop flag 140*g*, which indicates whether or not the passage point is a bus stop (here, "0" means that the passage point is not a bus stop and "1" means that the passage point is a bus stop), a bus stop ID 140*h*, which is used when the passage point is a bus stop as identification information of the bus stop, and an inter-passage point distance 140*i*, which indicates the distance between the passage point and its immediately preceding passage point, are associated with one another. The passage point records are arranged in the order in which the bus passes the passage points.

Returning to FIG. 1, the bus information storing unit 15 stores the bus information 150 for identifying passage points (including stop points), passage times (including stopping times), and the like of the bus. Information of each bus is set in advance in the bus information 150 in this embodiment. FIG. 3 is a diagram illustrating an example of the configuration of the bus information 150.

The bus information 150 includes, for each bus, a bus record where a bus ID 150*a*, which is identification information of the bus, a bus number 150*b*, which is identification information for identifying the bus throughout one business day, an inbound/outbound flag 150*c*, which indicates whether the bus is inbound or outbound on a route indicated by a route ID 150*d* (here, "0" means "outbound" and "1" means "inbound"), the route ID 150*d* of a route along which the bus runs, a speed 150*e*, which indicates the highest speed in catch-up driving (driving for making up for a delay) of the bus, an originating bus stop ID 150*f*, which is identification information of the originating bus stop of the bus, a destination bus stop ID 150*g*, which is identification information of the destination bus stop of the bus, a bus stop count 150*h*, which indicates the count of bus stops which the bus passes (including ones at which the bus stops), and detailed bus stop information are associated with one another. The detailed bus stop information includes, for each bus stop, a bus stop record where a bus stop ID 150*i*, which is identification information of the bus stop, an arrival time 150*j*, which indicates a time at which the bus arrives at the bus stop, a departure time 150*k*, which indicates a time at which the bus leaves the bus stop, and a stopping flag 150*l*, which indicates whether the bus stops at or passes the bus stop (here, "0" means that the bus passes the bus stop and "1" means that the bus stops at the bus stop), are associated with one another. The bus stop records are arranged in the order in which the bus passes the bus stops. The speed 150*e* is not limited to the highest speed in catch-up driving and may be other types of speed data such as the average speed in catch-up driving.

Returning to FIG. 1, the passage time information storing unit 16 stores the passage time information 160 for identifying a time at which a bus passes a specified output point or the like. FIG. 4 is a diagram illustrating an example of the configuration of the passage time information 160.

The passage time information 160 includes, for each output point, an output point record where an output point 160*a*, which includes information for identifying the output point such as coordinate information of the output point, a route ID 160*b*, which is identification information of a route that runs through the output point, and detailed information of a passage time at which a bus running along the route passes the output point are associated with one another. The detailed passage time information includes, for each bus, a passage time record where an earliest passage time 160*c*, which indicates the earliest time the bus passes the output point, a regular passage time 160*d*, which indicates a regular time the bus passes the output point, and a latest passage time 160*e*, which indicates the latest time the bus passes the output point, are associated with one another.

Returning to FIG. 1, the timetable information storing unit 17 stores the timetable information 170 for defining a timetable of a bus that passes an output point. FIG. 5 is a diagram illustrating an example of the configuration of the timetable information 170.

The timetable information 170 includes, for each output point, an output point record where an output point 170*a*, which includes information for identifying the output point, and detailed timetable information are associated with each other. The detailed timetable information includes passage time records in each of which a passage time (hour) 170*b*, an earliest passage time (minute) 170*c*, a regular passage time (minute) 170*d*, and a latest passage time (minute) 170*e* are associated with one another. The passage time records are arranged in chronological order of the regular passage time.

Returning to FIG. 1, the user terminal 2 includes an input unit 20, an output unit 21, and a communication unit 22.

The input unit 20 receives an input of information. For instance, the input unit 20 receives an input of information on a UI screen which is output by the output unit 21, and transmits the input information to the timetable generating device 1 via the communication unit 22 and the network 3.

The output unit 21 outputs information. For instance, the output unit 21 displays a UI screen received via the communication unit 22 from the timetable generating device 1.

The communication unit 22 transmits/receives information over the network 3.

Figure 6:
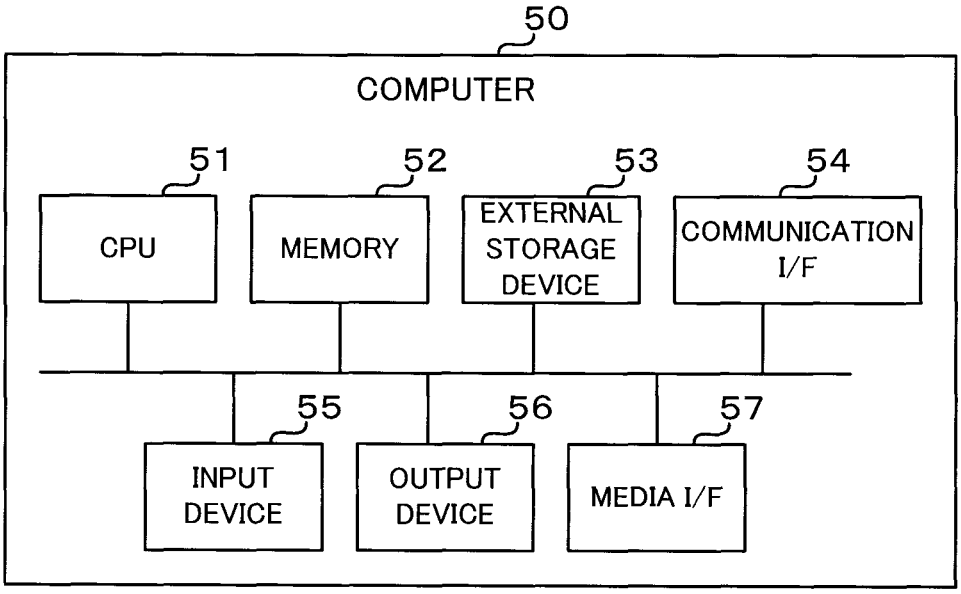
FIG. 6 is a diagram illustrating an example of the schematic configuration of a computer 50.

The timetable generating device 1 described above can be implemented by, for example, a computer 50 of FIG. 6 (which is a diagram illustrating an example of the schematic configuration of the computer 50). The computer 50 includes a central processing unit (CPU) 51, a memory 52, an external storage device 53 such as an HDD, the communication interface (I/F) 54 for connecting to a communication network by radio or by a cable, the input device 55 such as a mouse and/or a keyboard, the output device 56 such as a liquid crystal display, and a media I/F 57 for reading/writing information in a recording medium such as a digital versatile disk (DVD).

For example, the output point obtaining unit 10, the passage time identifying unit 11, the timetable generating unit 12, and the timetable outputting unit 13 can be implemented by loading onto the memory 52 a given program that is stored in the external storage device 53 and executing the loaded program with the CPU 51. Communication to/from the network 3 can be implemented by the CPU 51 using the communication I/F 54. The passage point information storing unit 14, the bus information storing unit 15, the passage time information storing unit 16, and the timetable information storing unit 17 can be implemented by the CPU 51 using the memory 52 or the external storage device 53.

The given program may be downloaded onto the external storage device 53 from a network via the communication I/F 54, before loaded onto the memory 52 and executed by the CPU 51. The given program may instead be loaded directly onto the memory 52 from a network via the communication I/F 54 to be executed by the CPU 51. The given program may also be loaded onto the external storage device 53 or the memory 52 by the computer 50 from a storage medium set in the media I/F 57.

The user terminal 2 can also be implemented by the computer 50 of FIG. 6, for example. The user terminal 2 is not limited to common personal computers (PCs) or similar devices, and may be a portable device such as a mobile PC, a smart phone, a tablet PC, or a cellular phone. The input unit 20 can be implemented by, for example, the CPU 51 using the input device 55. The output unit 21 can be implemented by, for example, the CPU 51 using the output device 56. The communication unit 22 can be implemented by, for example, the CPU 51 using the communication I/F 54.

The functional configurations of the timetable generating device 1 and the user terminal 2 described above with reference to FIG. 1 are classified by the specifics of main processing for easier understanding. The invention of this application is not limited by how the components are classified or by the names of the components. The configurations of the timetable generating device 1 and the user terminal 2 may be broken into more components depending on the specifics of processing. The components may also be classified so that a single component executes more processing procedures. The processing procedures of the respective components may be executed by one piece of hardware or a plurality of pieces of hardware. The processing procedures of the respective components may be implemented by one program or a plurality of programs. The storing units may be built in, for example, a storage device that is connected to the timetable generating device 1 via a network or the like. The data configurations of the information of FIG. 2 to the information of FIG. 5 are given as an example, and these pieces of information are not limited to the illustrated data configurations.

Processing executed in the timetable generating device 1 is described next.

Figure 7:
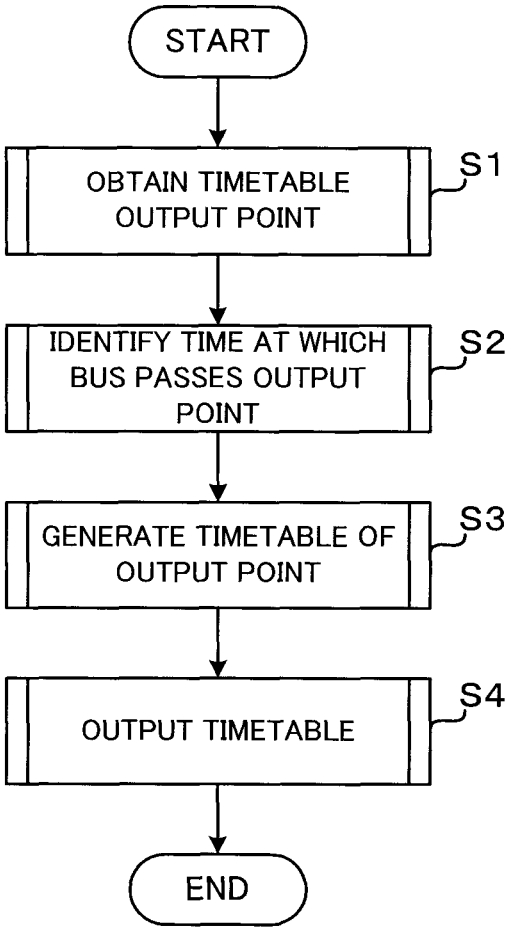
FIG. 7 is a flow chart illustrating an example of timetable generating processing.

FIG. 7 is a flow chart illustrating an example of timetable generating processing. This flow is started when, for example, the timetable generating device 1 receives an instruction to start timetable generating processing from the user terminal 2.

Figure 10:
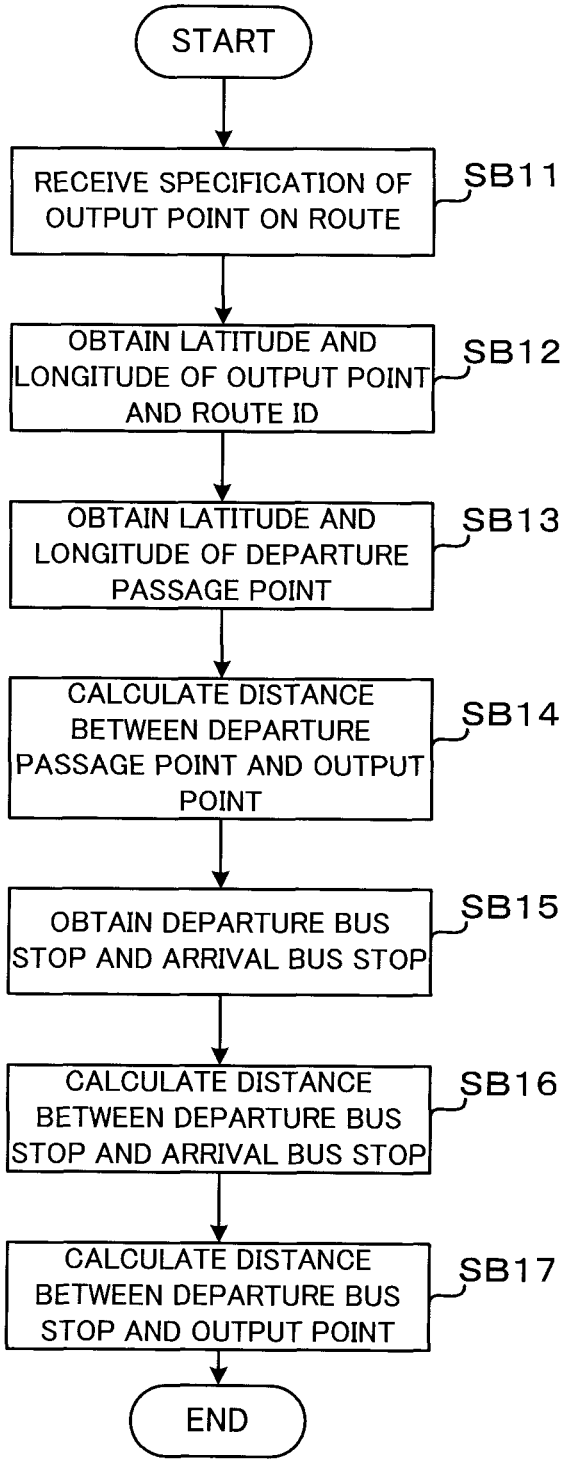
FIG. 10 is a flow chart illustrating an example of processing of obtaining an output point from a map.
Figure 11:
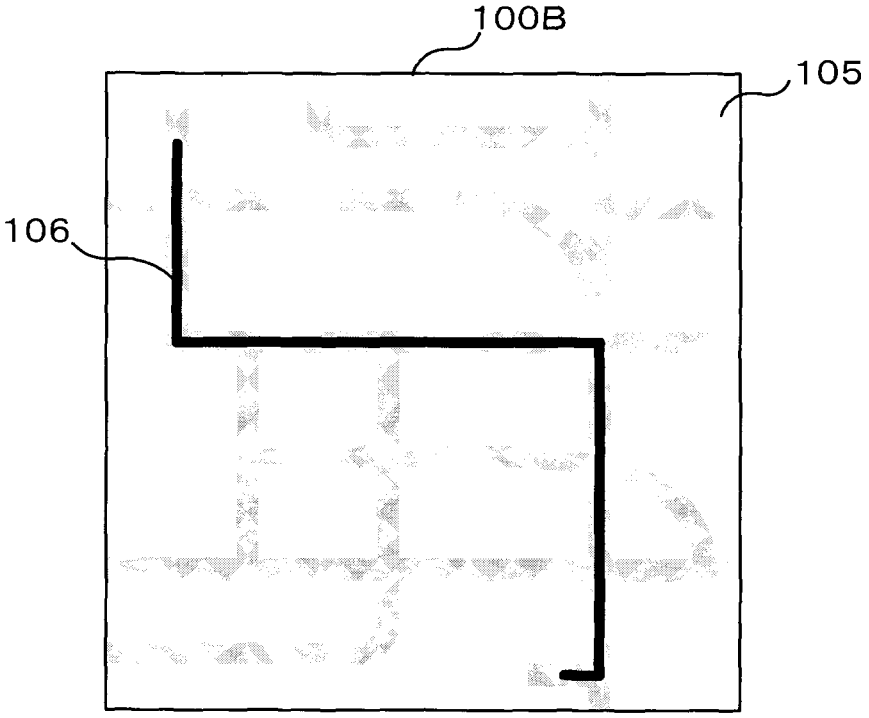
FIG. 11 is a diagram illustrating an example of a UI screen 100B for specifying an output point on a map.

The timetable generating device 1 first obtains from the user terminal 2 an output point at which a timetable is to be generated (Step S1). Details of Step S1 are described later with reference to FIGS. 8 to 11. Step S1 is executed through processing that uses a diagram (FIGS. 8 and 9) or processing that uses a map (FIGS. 10 and 11).

The timetable generating device 1 then identifies a time at which a bus passes the output point obtained in Step S1 (Step S2). Details of Step S2 are described later with reference to FIG. 12.

The timetable generating device 1 then generates a timetable of the output point based on the time that has been identified in Step S2 as a time at which the bus passes the output point (Step S3). Details of Step S3 are described later with reference to FIG. 13.

The timetable generating device 1 then outputs the timetable generated in Step S3 to the user terminal 2 (Step S4), and ends this flow. Details of Step S4 are described later with reference to FIG. 14.

Figure 8:
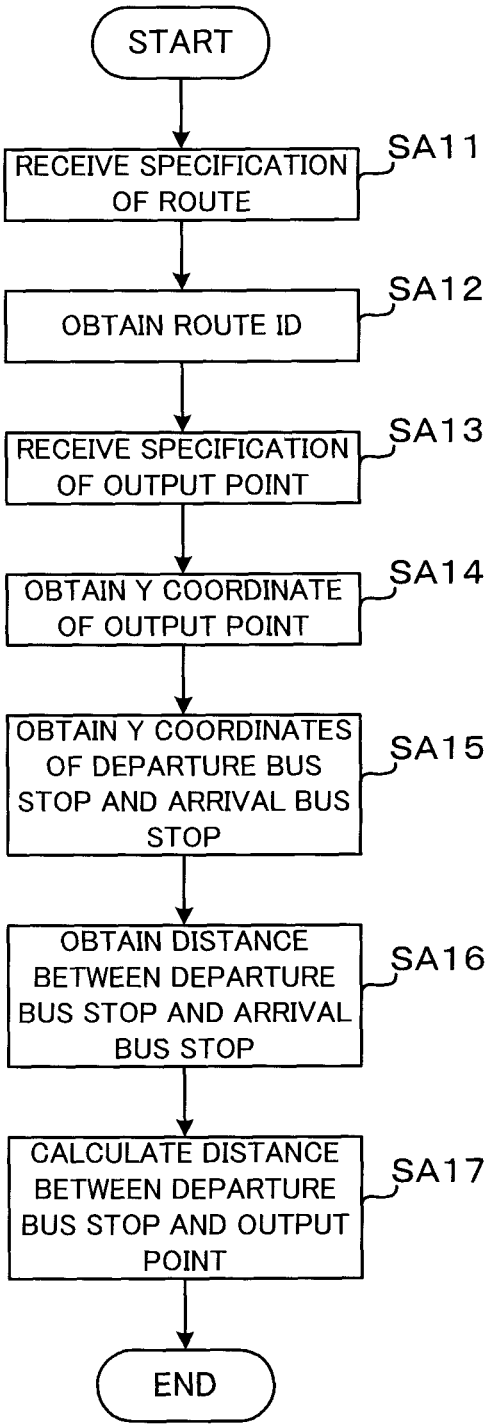
FIG. 8 is a flow chart illustrating an example of processing of obtaining an output point from a diagram.

FIG. 8 is a flow chart illustrating an example of processing of obtaining an output point from a diagram.

At the start of this flow, the output point obtaining unit 10 receives the specification of a bus route (Step SA11). To give a concrete example, the output point obtaining unit 10 outputs to the user terminal 2 a list of the route IDs 140*a* included in the passage point information 140, and receives the specification of a bus route from the user terminal 2. The output point obtaining unit 10 obtains the route ID of the bus route specified in Step SA11 (Step SA12).

The output point obtaining unit 10 then receives the specification of an output point (Step SA13). To give a concrete example, the output point obtaining unit 10 outputs to the user terminal 2 a UI screen that contains a diagram of the bus route specified in Steps SA11 and SA12, and receives the specification of an output point on the diagram.

The generation of a bus route diagram can be accomplished by existing technologies, and a detailed description thereof is omitted. For example, the output point obtaining unit 10 identifies a bus route record that includes the route ID 140*a* corresponding to the specified route ID out of the passage point information 140. The output point obtaining unit 10 also identifies a bus record that includes the route ID 150*d* corresponding to the specified route ID out of the bus information 150. The output point obtaining unit 10 generates a diagram based on the bus stop flag 140*g*, the bus stop ID 140*h*, the inter-passage point distance 140*i*, and other items that are included in the identified bus route record, and on the bus stop ID 150*i*, the arrival time 150*j*, the departure time 150*k*, and other items that are included in the identified bus record.

Figure 9:
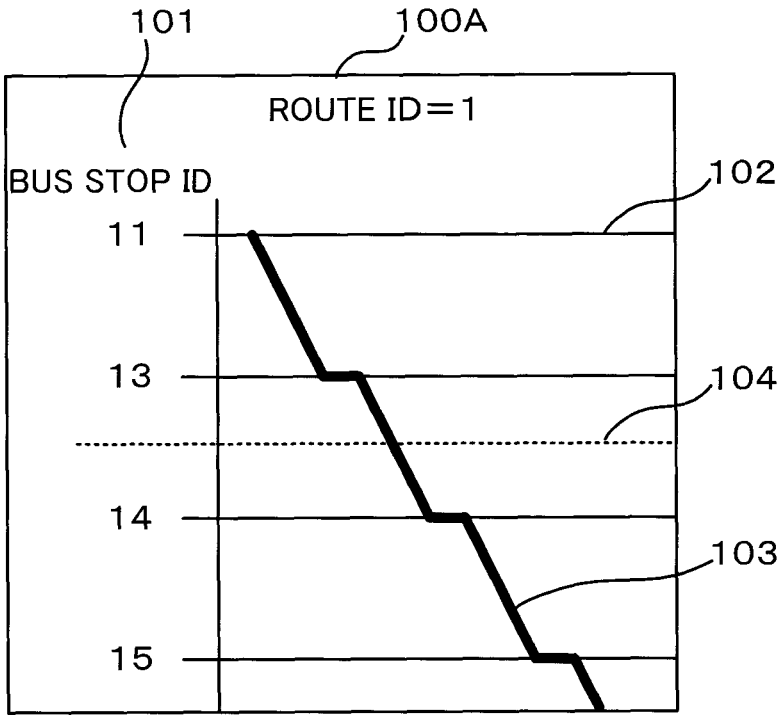
FIG. 9 is a diagram illustrating an example of a UI screen 100A for specifying an output point on a diagram.

The output point obtaining unit 10 outputs, for example, a UI screen 100A of FIG. 9 (which is a diagram illustrating an example of the UI screen 100A for specifying an output point on a diagram) to the user terminal 2.

The UI screen 100A displays a diagram that has distance and bus stop position on the vertical axis (Y-axis) and time on the horizontal axis (X-axis). Bus stop IDs 101 are arranged along the vertical axis. The diagram also displays lines 102 which indicate the respective bus stop positions, and a path 103 which indicates the position of a bus. Although one path 103 is displayed in FIG. 9, a plurality of paths 103 may be displayed to represent different buses (an inbound bus and an outbound bus on the same route are discriminated from each other). The diagram displays a line 104 which indicates the Y-coordinate position of a point pointed by a mouse pointer or the like that is moved around by the user.

The output point obtaining unit 10 receives the specification of an output point by receiving from the user terminal 2 mouse operation such as clicking on the UI screen 100A.

The configuration of the UI screen 100A is not limited to the example of FIG. 9 as long as the specification of an output point can be received on a diagram.

The output point obtaining unit 10 then obtains the Y coordinate of a point on the UI screen 100A where the mouse has been clicked (namely, the Y coordinate of the line 104), to thereby obtain the Y coordinate of the output point (Step SA14).

The output point obtaining unit 10 then obtains the Y coordinate of a bus stop that immediately precedes the specified output point (hereinafter also referred to as "departure bus stop") (namely, the Y coordinate of the line 102 that corresponds to the departure bus stop), and the Y coordinate of a bus stop that immediately follows the specified output point (hereinafter also referred to as "arrival bus stop") (namely, the Y coordinate of the line 102 that corresponds to the arrival bus stop) (Step SA15).

The departure bus stop and the arrival bus stop are reversed on the inbound run and the outbound run. The output point obtaining unit 10 therefore obtains the Y coordinates of the departure bus stop and the arrival bus stop on the inbound run and the Y coordinates of the departure bus stop and the arrival bus stop on the outbound run. In the example of FIG. 9, the departure bus stop is a bus stop that has a bus stop ID "13" and the arrival bus stop is a bus stop that has a bus stop ID "14" on the inbound run, whereas the departure bus stop is the bus stop that has a bus stop ID "14" and the arrival bus stop is the bus stop that has a bus stop ID "13" on the outbound run.

The output point obtaining unit 10 then obtains the distance between the departure bus stop and the arrival bus stop (Step SA16). Specifically, the output point obtaining unit 10 identifies a bus route record that includes the route ID 140*a* corresponding to the specified route ID out of the passage point information 140, and calculates the distance between the departure bus stop and the arrival bus stop based on the bus stop ID 140*h* and inter-passage point distance 140*i* of each passage point record that is included in the identified bus route record.

In the case where there is no other passage point record between a passage point record that includes the bus stop ID of the departure bus stop and a passage point record that includes the bus stop ID of the arrival bus stop, for example, the output point obtaining unit 10 uses the inter-passage point distance 140*i* of the passage point record of the arrival bus stop as the distance between the departure bus stop and the arrival bus stop. In the case where there is another passage point record between the passage point record that includes the bus stop ID of the departure bus stop and the passage point record that includes the bus stop ID of the arrival bus stop, on the other hand, the output point obtaining unit 10 calculates the sum of the inter-passage point distance 140*i* of the other passage point record and the inter-passage point distance 140*i* of the passage point record of the arrival bus stop, and uses the resultant value as the distance between the departure bus stop and the arrival bus stop.

The output point obtaining unit 10 obtains the distance between the departure bus stop and the arrival bus stop for both of the inbound run and the outbound run on the route. In this embodiment, the distance between the departure bus stop and the arrival bus stop is equal on the inbound run and on the outbound run.

The output point obtaining unit 10 then calculates the distance between the departure bus stop and the output point (Step SA17). To give a concrete example, the output point obtaining unit 10 calculates the direct distance between the departure bus stop and the output point by the following Mathematical Expression (1). The distance can of course be calculated by other methods than Mathematical Expression (1).

[Math. 1]

$$\text{Distance between departure bus stop and output point} = \text{distance between departure bus stop and arrival bus stop} \times (Y \text{ coordinate of output point} - Y \text{ coordinate of departure bus stop}) / (Y \text{ coordinate of arrival bus stop} - Y \text{ coordinate of departure bus stop}) \quad (1)$$

The distance between the departure bus stop and the arrival bus stop has been identified in Step SA16. The Y coordinate of the output point has been identified in Step SA14. The Y coordinate of the departure bus stop and the Y coordinate of the arrival bus stop have been identified in Step SA15.

The output point obtaining unit 10 calculates the distance between the departure bus stop and the output point for both of the inbound run and the outbound run on the route.

The output point obtaining unit 10 then ends this flow.

FIG. 10 is a flow chart illustrating an example of processing of obtaining an output point from a map.

At the start of this flow, the output point obtaining unit 10 receives the specification of an output point on a route (Step SB11). To give a concrete example, the output point obtaining unit 10 outputs to the user terminal 2 a UI screen that contains a map and routes, and receives the specification of a route and an output point on the map.

Displaying the screen that contains a map and routes can be accomplished by existing technologies, and a detailed description thereof is omitted. For example, the output point obtaining unit 10 obtains map information of a given range that contains a point specified by the user terminal 2 from a map information providing server (not shown) connected to the network 3. The output point obtaining unit 10 identifies a route that is contained in the obtained range of map information based on the passage point latitude 140*e*, passage point longitude 140*f*, and other items of each passage point record contained in bus route records of the passage point information 140. The output point obtaining unit 10 generates route information in which a line connects the respective passage points as nodes for the identified bus route, and superimposes the route information on the obtained map information, thereby generating the screen to be displayed.

The output point obtaining unit 10 outputs, for example, a UI screen 100B of FIG. 11 (which is a diagram illustrating an example of the UI screen 100B for specifying an output point on a map) to the user terminal 2.

The UI screen 100B displays a map 105 and a route 106. Although one route 106 is displayed in FIG. 11, a plurality of routes may be displayed. The UI screen 100B may also display graphic symbols or the like that represent passage points and bus stops.

The output point obtaining unit 10 receives the specification of a route and an output point by receiving mouse operation such as clicking on the route 106 on the UI screen 100B.

The configuration of the UI screen 100B is not limited to the example of FIG. 11 as long as the specification of a route and an output point can be received on a map.

The output point obtaining unit 10 then obtains the latitude and longitude of a point on the UI screen 100B where the mouse has been clicked, to thereby obtain the latitude and longitude of the output point, and obtains the route ID of the route clicked with the mouse (Step SB12).

The output point obtaining unit 10 subsequently obtains the latitude and longitude of a passage point that immediately precedes the specified output point (hereinafter also referred to as "departure passage point". The departure passage point may be a bus stop in some cases.) (Step SB13). To give a concrete example, the output point obtaining unit 10 identifies nodes (passage points) at both ends of a line that includes the mouse click point (the output point). Of the two identified nodes (passage points), the output point obtaining unit 10 identifies the node that is closer to the originating bus stop as a departure passage point and identifies the latitude and longitude of the departure passage point based on the passage point latitude 140*e* and passage point longitude 140*f* of each passage point record that is included in a bus route record whose route ID 140*a* corresponds to the specified route ID.

The output point obtaining unit 10 identifies a departure passage point and identifies the latitude and longitude of the departure passage point for both of the inbound run and the outbound run on the route. For the outbound run, the node that is closer to the destination bus stop is identified as a departure passage point.

The output point obtaining unit 10 then calculates the distance between the departure passage point and the output point (Step SB14). To give a concrete example, the output point obtaining unit 10 calculates the direct distance between the departure passage point and the output point by the following Mathematical Expression (2) or Mathematical Expression (3). The distance can of course be calculated by other methods than Mathematical Expression (2) and Mathematical Expression (3).

[Math. 2]

$$\text{Distance between departure passage point and output point} = \sqrt{\left(\begin{pmatrix}\text{east-west distance between departure}\\ \text{passage point and output point}\end{pmatrix}^2 + \begin{pmatrix}\text{south-north distance between departure}\\ \text{passage point and output point}\end{pmatrix}^2\right)} = \sqrt{\left(\begin{pmatrix}\cos(\text{departure passage point latitude}\times\pi/180)\times\\ \text{Earth radius}\times\\ \left(\left(\begin{pmatrix}\text{output point longitude}-\\ \text{departure passage point longitude}\end{pmatrix}\times\pi/180\right)\right)\end{pmatrix}^2 + \left(\begin{pmatrix}\text{Earth radius}\times\\ \left(\left(\begin{pmatrix}\text{output point latitude}-\\ \text{departure passage point latitude}\end{pmatrix}\times\pi/180\right)\right)\end{pmatrix}^2\right)\right)} \quad (2)$$

The latitude and longitude of the output point have been identified in Step SB12. The latitude and longitude of the departure passage point have been identified in Step SB13. The radius of the Earth can be set in advance.

[Math. 3]

$$\text{Distance between departure passage point and output point} = \sqrt{\left(\begin{pmatrix}\text{east-west distance between departure}\\ \text{passage point and output point}\end{pmatrix}^2 + \begin{pmatrix}\text{south-north distance between departure}\\ \text{passage point and output point}\end{pmatrix}^2\right)} = \sqrt{\left(\begin{pmatrix}\begin{pmatrix}\text{departure passage point longitude}-\\ \text{output point longitude}\end{pmatrix}\times\\ \text{distance constant of 1 degree of longitude}\end{pmatrix}^2 + \left(\begin{pmatrix}\begin{pmatrix}\text{departure passage point latitude}-\\ \text{output point latitude}\end{pmatrix}\times\\ \text{distance constant of 1 degree of latitude}\end{pmatrix}^2\right)\right)} \quad (3)$$

The latitude and longitude of the output point have been identified in Step SB12. The latitude and longitude of the departure passage point have been identified in Step SB13. The distance constant of 1 degree of longitude is, for example, set in advance for each degree of longitude. The distance constant of 1 degree of latitude is, for example, a single value set in advance.

The output point obtaining unit 10 calculates the distance between the departure passage point and the output point for both of the inbound run and the outbound run on the route.

The output point obtaining unit 10 then obtains a departure bus stop and an arrival bus stop (Step SB15). Specifically, the output point obtaining unit 10 identifies a departure bus stop and an arrival bus stop for the output point based on the identified departure passage point and on the passage point latitude 140*e*, passage point longitude 140*f*, and bus stop flag 140*g* of each passage point record that is included in the bus route record whose route ID 140*a* corresponds to the specified route ID.

In the case where the bus stop flag 140*g* of the departure passage point is "0: not a bus stop", for example, a passage point that is closest to the departure passage point in a section between the departure passage point and the originating bus stop and that has "1: is a bus stop" as the value of the bus stop flag 140*g* is identified as a departure bus stop. In the case where the bus stop flag 140*g* of the departure passage point is "1: is a bus stop", the departure passage point is identified as a departure bus stop. The output point obtaining unit 10 also identifies, as an arrival bus stop, a passage point that is closest to the departure passage point in a section between the departure passage point and the destination bus stop and that has "1: is a bus stop" as the value of the bus stop flag 140*g*. The output point obtaining unit 10 obtains the bus stop IDs 140*h* of the identified departure bus stop and arrival bus stop.

The output point obtaining unit 10 obtains a departure bus stop and an arrival bus stop for both of the inbound run and the outbound run on the route.

The output point obtaining unit 10 then obtains the distance between the departure bus stop and the arrival bus stop (Step SB16). Specifically, the output point obtaining unit 10 identifies a bus route record that includes the route ID 140*a* corresponding to the specified route ID out of the passage point information 140. The output point obtaining unit 10 calculates the distance between the departure bus stop and the arrival bus stop based on the bus stop ID 140*h* and inter-passage point distance 140*i* of each passage point record that is included in the identified bus route record. The specifics of the processing are the same as in Step SA16, and a description thereof is omitted here.

The output point obtaining unit 10 obtains the distance between the departure bus stop and the arrival bus stop for both of the inbound run and the outbound run on the route. In this embodiment, the distance between the departure bus stop and the arrival bus stop is equal on the inbound run and on the outbound run.

The output point obtaining unit 10 then calculates the distance between the departure bus stop and the output point (Step SB17). Specifically, the output point obtaining unit 10 calculates the distance between the departure bus stop and the departure passage point based on the inter-passage point distance 140*i* of each passage point record that is included in the bus route record whose route ID 140*a* corresponds to the specified route ID. The output point obtaining unit 10 adds the distance between the departure passage point and the output point which has been calculated in Step SB14 to the calculated distance between the departure bus stop and the departure passage point, thereby calculating the distance between the departure bus stop and the output point. This flow is ended at this point.

The output point obtaining unit 10 calculates the distance between the departure bus stop and the output point for both of the inbound run and the outbound run on the route.

Figure 12:
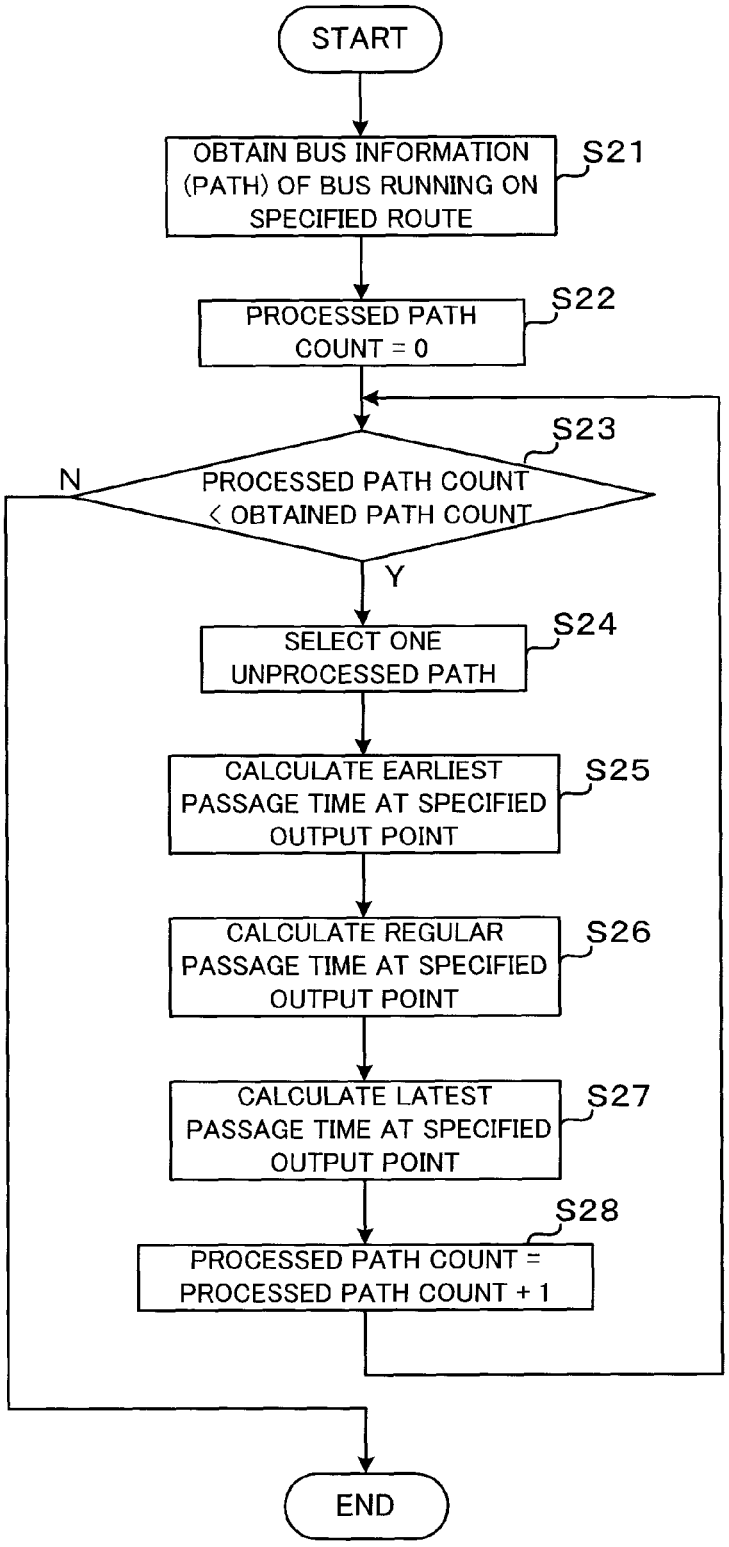
FIG. 12 is a flow chart illustrating an example of processing of identifying a time at which a bus passes an output point.

FIG. 12 is a flow chart illustrating an example of processing of identifying a time at which a bus passes an output point.

At the start of this flow, the passage time identifying unit 11 obtains bus information (the path) of a bus that runs on a specified route (Step S21). Specifically, the passage time identifying unit 11 obtains the route ID obtained in Step SA12 (see FIG. 8) or Step SB12 (see FIG. 10). The passage time identifying unit 11 also obtains from the bus information 150 any bus record that includes the route ID 150*d* corresponding to the obtained route ID. The count of obtained bus records is set as an obtained path count.

At this point, the passage time identifying unit 11 adds to the passage time information 160 an output point record that includes information for identifying the output point specified in the flow of FIG. 8 or FIG. 10 (coordinate information or the like) and the specified route ID as the output point 160*a* and the route ID 160*b*, respectively. Passage time records (each including the earliest passage time 160*c*, the regular passage time 160*d*, and the latest passage time 160*e*) of the detailed passage time information are set for each selected path in Steps S25 to S27 described below.

The passage time identifying unit 11 then sets 0 to a processed path count, which is the count of paths for which the time of passage of the specified output point has been calculated (Step S22).

The passage time identifying unit 11 then determines whether or not the processed path count is smaller than the obtained path count (Step S23).

When the processed path count is smaller than the obtained path count (Step S23: Y), the passage time identifying unit 11 selects one bus record of an unprocessed path out of the bus records obtained in Step S21 (Step S24).

The passage time identifying unit 11 then calculates the earliest passage time at the specified output point (Step S25). To give a concrete example, the passage time identifying unit 11 uses the following Mathematical Expression (4) to calculate the earliest passage time at the specified output point. The calculated earliest passage time is set as the earliest passage time 160*c* in the passage time record of the selected path. The earliest passage time can of course be calculated by other methods than Mathematical Expression (4).

[Math. 4]

$$\text{Earliest passage time} = \text{departure time of departure bus stop} + (\text{distance between departure bus stop and output point/highest catch-up driving speed}) \quad (4)$$

The bus stop ID of the departure bus stop has been identified in Step SA15 (see FIG. 8) or Step SB15 (see FIG. 10). The departure time of the departure bus stop can be obtained based on the bus stop ID of the departure bus stop and on the bus stop ID 150*i* and departure time 150*k* of each bus stop record that is included in the bus record of the path selected in Step S24. The distance between the departure bus stop and the output point has been calculated in Step SA17 (see FIG. 8) or Step SB17 (see FIG. 10). The highest catch-up driving speed is the speed 150*e* that is obtained from the bus record of the path selected in Step S24.

When the inbound/outbound flag 150*c* of the bus record of the selected path is "1: inbound", the passage time identifying unit 11 calculates the earliest passage time by using the departure time of the departure bus stop and the distance between the departure bus stop and the output point on the inbound run. When the flag is "0: outbound", the earliest passage time is calculated with the use of the departure time of the departure bus stop and the distance between the departure bus stop and the output point on the outbound run.

The passage time identifying unit 11 then calculates the regular passage time at the specified output point (Step S26). To give a concrete example, the passage time identifying unit 11 uses the following Mathematical Expression (5) to calculate the regular passage time at the specified output point. The calculated regular passage time is set as the regular passage time 160*d* in the passage time record of the selected path. The regular passage time can of course be calculated by other methods than Mathematical Expression (5).

[Math. 5]

Regular passage time=departure time of departure bus stop+((arrival time of arrival bus stop−departure time of departure bus stop)×(distance between departure bus stop and output point/distance between departure bus stop and arrival bus stop)) (5)

The bus stop ID of the departure bus stop, the departure time of the departure bus stop, and the distance between the departure bus stop and the output point are obtained in the manner described above. The bus stop ID of the arrival bus stop has been identified in Step SA15 (see FIG. 8) or Step SB15 (see FIG. 10). The arrival time of the arrival bus stop can be obtained based on the bus stop ID of the arrival bus stop and on the bus stop ID 150*i* and arrival time 150*j* of each bus stop record that is included in the bus record of the path selected in Step S24. The distance between the departure bus stop and the arrival bus stop has been calculated in Step SA16 (see FIG. 8) or Step SB16 (see FIG. 10).

When the inbound/outbound flag 150*c* of the bus record of the selected path is "1: inbound", the passage time identifying unit 11 calculates the regular passage time by using the departure time of the departure bus stop, the arrival time of the arrival bus stop, the distance between the departure bus stop and the output point, and the distance between the departure bus stop and the arrival bus stop on the inbound run. When the flag is "0: outbound", the regular passage time is calculated with the use of the departure time of the departure bus stop, the arrival time of the arrival bus stop, the distance between the departure bus stop and the output point, and the distance between the departure bus stop and the arrival bus stop on the outbound run.

The passage time identifying unit 11 then calculates the latest passage time at the specified output point (Step S27). To give a concrete example, the passage time identifying unit 11 uses the following Mathematical Expression (6) to calculate the latest passage time at the specified output point. The calculated latest passage time is set as the latest passage time 160*e* in the passage time record of the selected path. The latest passage time can of course be calculated by other methods than Mathematical Expression (6).

[Math. 6]

Latest passage time=arrival time of arrival bus stop−((distance between departure bus stop and arrival bus stop−distance between departure bus stop and output point)/highest catch-up driving speed) (6)

The bus stop ID of the arrival bus stop, the arrival time of the arrival bus stop, the distance between the departure bus stop and the arrival bus stop, the distance between the departure bus stop and the output point, and the highest catch-up driving speed are obtained in the manner described above.

When the inbound/outbound flag 150*c* of the bus record of the selected path is "1: inbound", the passage time identifying unit 11 calculates the latest passage time by using the arrival time of the arrival bus stop, the distance between the departure bus stop and the arrival bus stop, and the distance between the departure bus stop and the output point on the inbound run. When the flag is "0: outbound", the latest passage time is calculated with the use of the arrival time of the arrival bus stop, the distance between the departure bus stop and the arrival bus stop, and the distance between the departure bus stop and the output point on the outbound run.

The passage time identifying unit 11 then adds 1 to the processed path count (Step S28), and moves the processing back to Step S23.

When the processed path count is equal to or larger than the obtained path count (Step S23: N), on the other hand, the passage time identifying unit 11 ends this flow.

Figure 13:
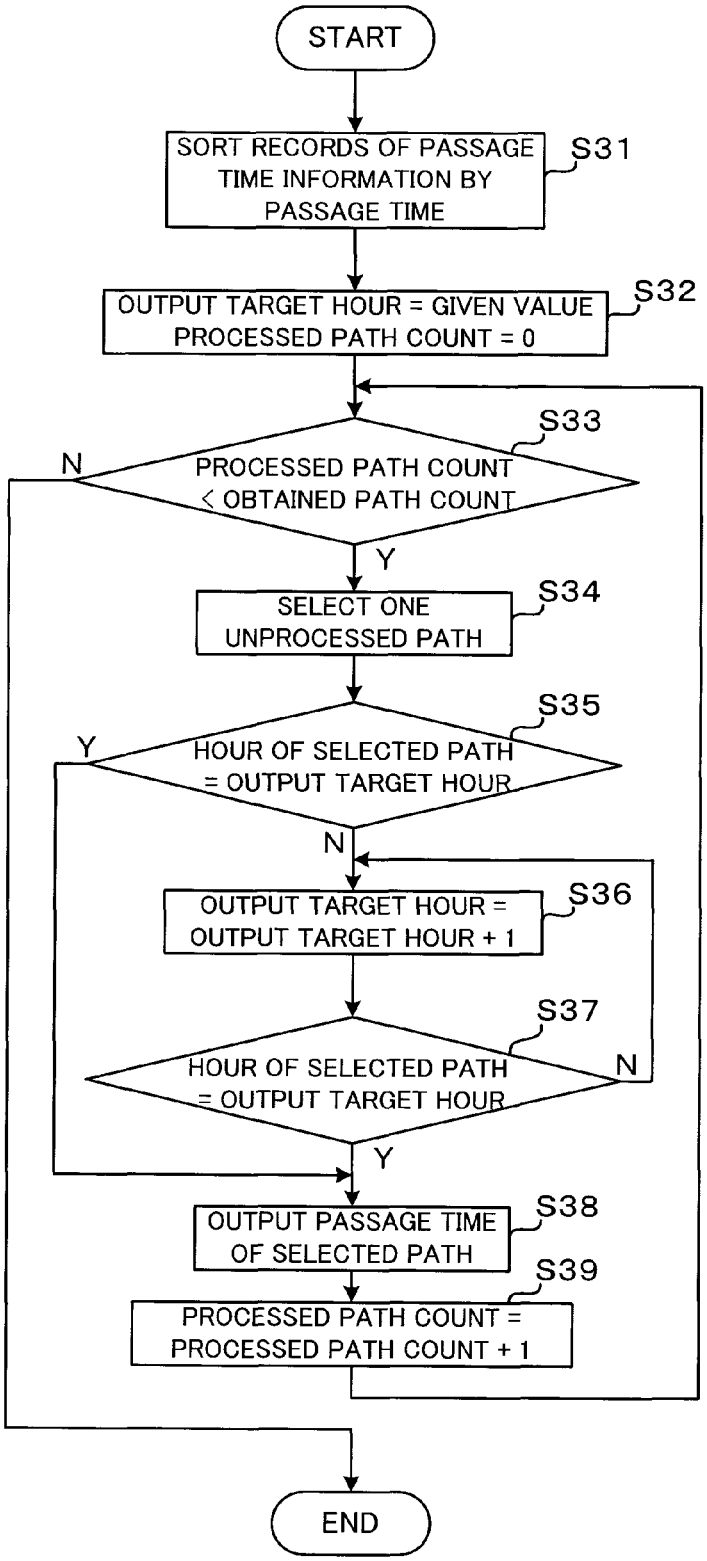
FIG. 13 is a flow chart illustrating an example of processing of generating a timetable of an output point.

FIG. 13 is a flow chart illustrating an example of processing of generating a timetable of an output point.

At the start of this flow, the timetable generating unit 12 sorts records of the passage time information by passage time (Step S31). Specifically, the timetable generating unit 12 sorts passage time records (each including the earliest passage time 160*c*, the regular passage time 160*d*, and the latest passage time 160*e*) that are included in the output point record of the passage time information 160 that has been generated in the flow of FIG. 13 in chronological order of the regular passage time. The count of the passage time records is set as the obtained path count.

The timetable generating unit 12 then sets a given value to an output target hour and sets 0 to a processed path count, which is the count of paths for which a passage time of a specified output point has been output (Step S32). The output target hour is the hour of a time and the given value is the hour which is output before the minute on a timetable. The given value may be set in advance or may be received from the user terminal 2.

At this point, the timetable generating unit 12 adds to the time table information 170 an output point record that includes information for identifying the output point specified in the flow of FIG. 8 or FIG. 10 (coordinate information or the like) as the output point 170*a*. The timetable generating unit 12 also sets the current output target hour as the passage time (hour) 170*b* in association with this output point 170*a*. Passage time records (each including the earliest passage time (minute) 170*c*, the regular passage time (minute) 170*d*, and the latest passage time (minute) 170*e*) of the detailed timetable information are set for each selected path in Step S38 described below.

The timetable generating unit 12 determines whether or not the processed path count is smaller than the obtained path count (Step S33).

When the processed path count is smaller than the obtained path count (Step S33: Y), the timetable generating unit 12 selects one passage time record of an unprocessed path out of passage time records included in the output point record of the passage time information 160 that has been generated in the flow of FIG. 12 (Step S34).

The timetable generating unit 12 then determines whether or not the hour of the regular passage time 160*d* in the passage time record of the path selected in Step S34 is the same as the output target hour (Step S35). In the case where the hour of the regular passage time 160*d* is the same as the output target hour (Step S35: Y), the timetable generating unit 12 moves the processing to Step S38. In the case where the hour of the regular passage time 160*d* is not the same as the output target hour (Step S35: N), the timetable generating unit 12 moves the processing to Step S36.

The timetable generating unit 12 adds 1 to the output target hour (Step S36).

The timetable generating unit 12 sets the resultant output target hour as the passage time (hour) 170*b* in association with the output point 170*a* of the output point record added in Step S32.

The timetable generating unit 12 then determines whether or not the hour of the regular passage time 160*d* in the passage time record of the path selected in Step S34 is the same as the output target hour (Step S37). In the case where the hour of the regular passage time 160*d* is the same as the output target hour (Step S37: Y), the timetable generating unit 12 moves the processing to Step S38. In the case where the hour of the regular passage time 160*d* is not the same as the output target hour (Step S37: N), the timetable generating unit 12 moves the processing back to Step S36.

The timetable generating unit 12 then outputs passage times of the path selected in Step S34 (Step S38). Specifically, the timetable generating unit 12 extracts the minute of the earliest passage time 160*c*, the minute of the regular passage time 160*d*, and the minute of the latest passage time 160*e* from the passage time record of the path selected in Step S34, and adds the extracted values as the earliest passage time (minute) 170*c*, the regular passage time (minute) 170*d*, and the latest passage time (minute) 170*e*, respectively, in association with the passage time (hour) 170*b* that has been set in Step S32 or Step S36.

The timetable generating unit 12 then adds 1 to the processed path count (Step S39), and moves the processing back to Step S33.

In the case where the processed path count is equal to or larger than the obtained path count (Step S33: N), on the other hand, the timetable generating unit 12 ends this flow.

FIG. 14 is a diagram illustrating an example of a UI screen 130 for outputting a timetable.

When the time table information 170 of a specified output point is generated (see FIG. 13), the timetable outputting unit 13 generates a timetable based on the timetable information 170 of this output point and outputs the UI screen 130 that contains the timetable to the user terminal 2.

The UI screen 130 displays a timetable that has the hour of a passage time on the vertical axis and the minute of a passage time on the horizontal axis. As the minute of a passage time, the earliest passage time (minute), the regular passage time (minute), and the latest passage time (minute) are displayed in association with one another for each path (in the order of [earliest-regular-latest] in FIG. 14). The hour of a time on the timetable corresponds to the passage time (hour) 170*b* of the timetable information 170, and the minute of a time on the timetable corresponds to one of the earliest passage time (minute) 170*c*, regular passage time (minute) 170*d*, and latest passage time (minute) 170*e* of a path in the timetable information 170.

The configuration of the UI screen 130 is not limited to the example of FIG. 14 as long as a time at which a bus passes an output point can be shown.

The units of processing of the flows described above with reference to FIGS. 7, 8, 10, 12, and 13 divide processing of the timetable generating device 1 based on the specifics of main processing for easier understanding. The invention of this application is not limited by how the units of processing divide or by the names of the units of processing. The processing of the timetable generating device 1 may be broken into more units of processing depending on the specifics of processing. The units of processing may also divide the processing of the timetable generating device 1 so that a single unit of processing includes more processing procedures. The processing order of each flow described above is also not limited to the illustrated example.

An embodiment of the present invention has now been described. According to the described embodiment, information about a time at which a vehicle of public transportation passes an arbitrary point can be provided.

Specifically, a timetable showing a time at which a vehicle of public transportation passes an output point specified by a user is generated and presented to the user in this embodiment. The user is thus provided with information about a time at which a vehicle of public transportation passes an arbitrary point. In addition, the timetable provided in this embodiment includes passage times for both of the inbound run and the outbound run on a route that runs through the specified output point. The user can thus know a passage time on the inbound run and on the outbound run each. Moreover, the earliest passage time and the latest passage time as well as the regular passage time are presented as passage times in this embodiment. The user can therefore know the earliest passage time and the latest passage time in addition to the regular passage time.

For example, a timetable generated for a specified point may be provided to a contractor contracted to do a construction work at or near this point, thereby enabling the contractor to plan the construction so that the moving or parking of vehicles for transporting construction materials and heavy equipment does not coincide with the passage time of public transportation. The timetable may also be provided to, for example, providers of public transportation services.

The embodiment of the present invention described above is intended to give an exemplification of the spirit and scope of the present invention, and is not to limit the present invention. Many alternatives, adjustments, and modification examples of the present invention are obvious to the skilled in the art.

For instance, while a passage time is identified for the inbound run and the outbound run both in the embodiment described above, the timetable generating device 1 may receive the specification of one of the inbound run and the outbound run on a specified route from the user terminal 2 so that a passage time is identified for one of the inbound run and the outbound run.

For instance, while a timetable including a passage time on the inbound run and a passage time on the outbound run both is generated and output in the embodiment described above, a passage time on the inbound run and a passage time on the outbound run may be displayed differently (e.g., by displaying in different colors or by marking) so that the two are distinguished from each other. Alternatively, an inbound timetable and an outbound timetable may be output separately.

For instance, while three types of passage time, the earliest passage time, the regular passage time, and the latest passage time, are identified in the embodiment described above, only one or two out of the three types of passage time may be identified. Which of the passage time types is to be identified may be specified by the user terminal 2.

For instance, while one route is specified on a map in the embodiment described above, in the case where an output point in a section where a plurality of routes partially overlap one another is specified, a time at which a bus passes the output point may be identified for each of the routes. The timetable generating device 1 in this case may output one timetable for all of the routes or for each of the routes separately.

For instance, the user terminal 2 may save timetable information generated by and obtained from the timetable generating device 1 to output an alarm or the like when the current time enters a time window that starts from the earliest passage time and ends at the latest passage time for one of the paths on the timetable.

The present invention is applicable not only to buses but also to train and other modes of public transportation.

REFERENCE SIGNS LIST

1: timetable generating device
2: user terminal
3: network
5: timetable generating system
10: output point obtaining unit
11: passage time identifying unit
12: timetable generating unit
13: timetable outputting unit
14: passage point information storing unit
15: bus information storing unit
16: passage time information storing unit
17: timetable information storing unit
20: input unit
21: output unit
22: communication unit
50: computer
51: CPU
52: memory
53: external storage device
54: communication interface (I/F)
55: input device
56: output device
57: media I/F
100A: UI screen
101: bus stop ID
102: line
103: path
104: line
100B: UI screen
105: map
106: route
130: UI screen
140: passage point information
140*a*: route ID
140*b*: originating bus stop ID
140*c*: destination bus stop ID
140*d*: passage point count
140*e*: passage point latitude
140*f*: passage point longitude
140*g*: bus stop flag
140*h*: bus stop ID
140*i*: inter-passage point distance
150: bus information
150*a*: bus ID
150*b*: bus number
150*c*: inbound/outbound flag
150*d*: route ID
150*e*: speed
150*f*: originating bus stop ID
150*g*: destination bus stop ID
150*h*: bus stop count
150*i*: bus stop ID
150*j*: arrival time
150*k*: departure time
150*l*: stopping flag
160: passage time information
160*a*: output point
160*b*: route ID
160*c*: earliest passage time
160*d*: regular passage time
160*e*: latest passage time
170: timetable information
170*a*: output point
170*b*: passage time (hour)
170*c*: earliest passage time (minute)
170*d*: regular passage time (minute)
170*e*: latest passage time (minute)

The invention claimed is:

1. A timetable generating device, comprising:

an obtaining unit which obtains location information of a specified point which is an arbitrary point between established stopping points along a route and for which a timetable is to be generated, the specified point being specified by user operation;

a time identifying unit which identifies at least one passage time at which a vehicle of public transportation running on the route passes the specified point;

a timetable generating unit which generates timetable information that includes each identified passage time; and a timetable outputting unit which outputs a timetable based on the timetable information, wherein the time identifying unit identifies, for each passage time, a regular passage time and at least one of a latest passage time or a earliest passage time at which the vehicle of public transportation passes the specified point, the timetable generating unit generates the timetable information that includes, for each passage time, the regular passage time and at least one of the latest passage time or the earliest passage time, and the timetable outputting unit outputs the timetable which displays, for each passage time, at least one of the latest passage time or the earliest passage time in association with the regular passage time based on the timetable information.

2. A timetable generating device according to claim 1, wherein the obtaining unit obtains information of a specified route which runs through the specified point, and wherein the time identifying unit identifies a passage time at which the vehicle of public transportation passes the specified point based on the location information of the specified point, location information of passage points that the vehicle of public transportation running on the specified route passes and that precede and follow the specified point, and information about passage times at which the vehicle of public transportation passes the passage points that precede and follow the specified point.

3. A timetable generating device according to claim 2, wherein the obtaining unit outputs a first screen which contains a diagram of the vehicle of the public transportation running on the specified route to receive specification of the specified point on the first screen, or outputs a second screen which contains route information and map information to receive specification of the specified route and specification of the specified point on the second screen.

4. A timetable generating device according to claim 2, wherein the time identifying unit identifies a passage time at which the vehicle of public transportation passes the specified point for at least one of inbound run and outbound run.

5. A timetable generating device according to claim 1, wherein the time identifying unit identifies a passage time at which the vehicle of public transportation passes the specified point for at least one of inbound run and outbound run.

6. A timetable generating device according to claim 5, wherein the time identifying unit identifies passage times at which the vehicle of public transportation passes the specified point for the inbound run and for the outbound run, and wherein the timetable outputting unit outputs one timetable which displays the passage time on the inbound run and the passage time on the outbound run differently, or separate timetables one of which displays the passage time on the inbound run and another of which displays the passage time on the outbound run.

7. A timetable generating method for use in a timetable generating device which comprises an obtaining unit, a timetable identifying unit, a timetable generating unit, and a timetable outputting unit, the method comprising:

an obtaining step of obtaining, by the obtaining unit, location information of a specified point which is an arbitrary point between established stopping points along a route and for which a timetable is to be generated, the specified point being specified by user operation;

a time identifying step of identifying, by the timetable identifying unit, at least one passage time at which a vehicle of public transportation running on the route passes the specified point;

a timetable generating step of generating, by the timetable generating unit, timetable information that includes each identified passage time; and a timetable outputting step of outputting, by the timetable outputting unit, a timetable based on the timetable information, wherein the time identifying step identifies, for each passage time, a regular passage time and at least one of a latest passage time or a earliest passage time at which the vehicle of public transportation passes the specified point, the timetable generating step generates the timetable information that includes, for each passage time, the regular passage time and at least one of the latest passage time or the earliest passage time, and the timetable outputting step outputs the timetable which displays, for each passage time, at least one of the latest passage time or the earliest passage time in association with the regular passage time based on the timetable information.

8. A timetable generating system, comprising:

a user terminal; and a timetable generating device, wherein the user terminal comprises:

an input unit which receives an input of location information of a specified point which is an arbitrary point between established stopping points along a route and for which a timetable is to be generated, the specified point being specified by user operation;

a transmission unit which transmits the input location information of the specified point to the timetable generating device;

a reception unit which receives from the timetable generating device a timetable that includes at least one passage time at which a vehicle of public transportation running on the route passes the specified point; and an output unit which outputs the received timetable, wherein the timetable generating device comprises:

an obtaining unit which obtains the location information of the specified point from the user terminal;

a time identifying unit which identifies the at least one passage time at which the vehicle of public transportation passes the specified point;

a timetable generating unit which generates timetable information that includes each identified passage time; and a timetable outputting unit which transmits the timetable to the user terminal based on the timetable information, wherein the time identifying unit identifies, for each passage time, a regular passage time and at least one of a latest passage time or a earliest passage time at which the vehicle of public transportation passes the specified point, the timetable generating unit generates the timetable information that includes, for each passage time, the regular passage time and at least one of the latest passage time or the earliest passage time, and the timetable outputting unit transmits the timetable which displays, for each passage time, at least one of the latest passage time or the earliest passage time in association with the regular passage time based on the timetable information.

9. A timetable generating method for use in a timetable generating system which comprises a user terminal and a timetable generating device, the method comprising:

an input step of receiving, by the user terminal, an input of location information of a specified point which is an arbitrary point between established stopping points along a route and for which a timetable is to be generated, the specified point being specified by user operation;

a transmission step of transmitting, by the user terminal, the input location information of the specified point to the timetable generating device;

an obtaining step of obtaining, by the timetable generating device, the location information of the specified point from the user terminal;

a time identifying step of identifying, by the timetable generating device, at least one passage time at which a vehicle of public transportation running on the route passes the specified point;

a timetable generating step of generating, by the timetable generating device, timetable information that includes each identified passage time;

a timetable outputting step of transmitting, by the timetable generating device, the timetable to the user terminal based on the timetable information;

a reception step of receiving, by the user terminal, the timetable from the timetable generating device; and an output step of outputting, by the user terminal, the received timetable, wherein the time identifying step identifies, for each passage time, a regular passage time and at least one of a latest passage time or a earliest passage time at which the vehicle of public transportation passes the specified point, the timetable generating step generates the timetable information that includes, for each passage time, the regular passage time and at least one of the latest passage time or the earliest passage time, and the timetable outputting step transmits the timetable which displays, for each passage time, at least one of the latest passage time or the earliest passage time in association with the regular passage time based on the timetable information.

10. A user terminal configured to hold communication to/from a timetable generating device, comprising:

an input unit which receives an input of location information of a specified point which is an arbitrary point between established stopping points along a route and for which a timetable is to be generated, the specified point being specified by user operation;

a transmission unit which transmits the input location information of the specified point to the timetable generating device;

a reception unit which receives from the timetable generating device a timetable that includes at least one passage time at which a vehicle of public transportation running on the route passes the specified point; and an output unit which outputs the received timetable, wherein the reception unit receives the timetable which displays, for each passage time, at least one of a latest passage time or a earliest passage time in association with a regular passage time at which the vehicle of public transportation passes the specified point.

* * * * *